US006067809A

United States Patent [19]

Whited

[11] Patent Number: 6,067,809

[45] Date of Patent: May 30, 2000

[54] REFRIGERATOR DAMPER DOOR CIRCUIT

[75] Inventor: David R. Whited, Brentwood, Tenn.

[73] Assignee: France/Scott Fetzer Company, Fairview, Tenn.

[21] Appl. No.: 09/228,350

[22] Filed: Jan. 11, 1999

[51] Int. Cl.[7] ..... F25D 17/06

[52] U.S. Cl. ..... 62/187

[58] Field of Search ..... 62/186, 187; 236/49.3

[56] References Cited

U.S. PATENT DOCUMENTS

| | | | |
|---|---|---|---|
| 4,688,393 | 8/1987 | Linstromberg et al. | 62/187 |
| 5,477,699 | 12/1995 | Guess et al. | 62/187 |
| 5,896,749 | 4/1999 | Livers, Jr. | 62/187 |

*Primary Examiner*—William E. Tapolcai
*Attorney, Agent, or Firm*—Wood, Herron & Evans, L.L.P.

[57] ABSTRACT

A control circuit for supplying current from an electrical power source to a damper motor and an evaporator fan motor of a two compartment refrigeration unit. The control circuit includes a first and second thermostatic switches to regulate the temperature in respective first and second refrigeration compartments. The control circuit further includes a first mechanically actuated switch having a first common contact electrically connected to the damper motor. A first contact of the first switch connects the damper motor to the power source via the second thermostatic switch in response to a decrease in temperature in the second compartment. A second contact of the first switch connects the damper motor to the power source via the second thermostatic switch in response to an increase in temperature in the second compartment. The control circuit further has a second mechanically actuated switch with a second common contact connected to the evaporator fan motor. A first contact of the second switch connects the evaporator fan motor to the power source via the first thermostatic switch in response to an increase in temperature of the first compartment. A second contact in the second switch connects the power source to the evaporator fan motor via the second thermostatic switch in response to an increase in temperature of the second compartment.

25 Claims, 3 Drawing Sheets

REFRIGERATOR DAMPER DOOR CIRCUIT

BACKGROUND OF THE INVENTION

The present invention relates to electric circuits for controlling the electrical components of a refrigeration unit having an active damper therein.

A commercial or domestic refrigeration unit (e.g. a refrigerator or freezer) typically includes several electrical components which must be activated in a thermostatically controlled manner to provide refrigeration. These components typically include a compressor and electric fans. The compressor compresses the cooling media upon exit from the evaporator inside of the refrigeration unit, and delivers the compressed cooling media to a condenser outside of the refrigeration unit. The electric fans are typically positioned adjacent to the evaporator inside of the unit and adjacent to the condenser outside of the unit, to effect heat transfer to/from the evaporator and condenser to the air surrounding those components. Typically, power is provided to the compressor and fans by a thermostatic switch located inside of the refrigeration unit; in essence, the thermostatic switch closes when the inside temperature exceeds a threshold, causing power to be applied simultaneously to the compressor and fans. Power continues to be applied until the inside temperature reduces and the thermostatic switch opens, at which time the compressor and fans turn off.

Many modern refrigeration units include a fresh food compartment for storing food above a freezing temperature, for example, 32° F. The fresh food compartment is normally isolated from a main or freezer compartment for storing food below the freezing temperature. Often, the temperatures of the fresh food and freezing compartments can be separately controlled. To provide cooling to the fresh food compartment, the fresh food compartment is typically equipped with an active damper door, controlled by a damper motor. When the damper door is open, typically the evaporator fan is energized to move cooling air from inside of the freezer compartment into the fresh food compartment. When the damper door is closed, the fresh food compartment is isolated from the freezer compartment, and its temperature can change separately from the freezer compartment.

In a typical refrigeration unit, the fresh food compartment is equipped with its own thermostatic switch to permit thermostatic control of the temperature of the fresh food compartment. This thermostatic switch detects when the temperature of the fresh food compartment exceeds a threshold, indicating that cool air from the freezer compartment must be introduced into the fresh food compartment. When the thermostatic switch detects this condition, the thermostatic switch changes state to its "hot" condition, in which it delivers electrical power to the damper motor to open the damper, and also delivers electrical power to the evaporator fan. When the fresh food compartment cools, the thermostatic switch again changes state to its "cool" condition, in which it delivers electrical power to the damper motor to close the damper, and ceases delivery of electrical power to the evaporator fan.

Most modern refrigeration units utilize the above-described operation cycle, however, while the operating cycle in most refrigeration units is the same, there are many different mechanisms and control circuits used to control the refrigeration components in implementing that operating cycle. Further, as disclosed in U.S. Pat. No. 5,477,699, entitled "Evaporator Fan Control for a Refrigerator", many refrigeration units utilize at least three mechanically operative switches to control the operation of the damper motor and evaporation fan. Other control circuits may utilize additional switches and other components, for example, a capacitor, etc. Each additional switch or other component used to control the fresh food compartment damper increases the cost of the refrigeration control circuit, and may also reduce the reliability of the circuit as a result of the greater number of contact points.

SUMMARY OF THE INVENTION

The present invention provides an improved circuit for operating the damper and evaporation fan motors that utilizes fewer parts and thus, has the advantages of costing less and operating more reliably.

In accordance with the principles of the present invention and the described embodiments, the present invention provides a control circuit to supply current from an electrical power source to a damper motor and an evaporator fan motor of a two compartment refrigeration unit. The damper motor opens and closes a damper door between first and second refrigeration compartments, and the control circuit includes a first thermostatic switch to regulate the temperature in the first refrigeration compartment. The first thermostatic switch is connected to the electrical power source and provides an electrical path in response to an increase in temperature in the first compartment. A second thermostatic switch regulates the temperature in the second refrigeration compartment, and the second thermostatic switch is connected to the electrical power source and provides first and second current paths in response a respective increase and decrease in temperature in the second compartment. The control circuit further includes a first mechanically actuated switch having a first common contact electrically connected to the damper motor, and a first contact connects the damper motor to the power source via the second thermostatic switch in response to a decrease in temperature in the second compartment. A second contact of the first switch connects the damper motor to the power source via the second thermostatic switch in response to an increase in temperature in the second compartment. The control circuit further has a second mechanically actuated switch with a second common contact connected to the evaporator fan motor and a first contact that connects the evaporator fan motor to the power source via the first thermostatic switch in response to an increase in temperature of the first compartment. A second contact in the second switch connects the power source to the evaporator fan motor via the second thermostatic switch in response to an increase in temperature of the second compartment. The use of only two mechanically actuated switches reduces the cost of the control circuit and improves its reliability.

In one aspect, the first thermostatic switch is a single-pole switch and the second thermostatic switch is a two-pole switch. In another aspect of the invention, the first and second mechanically actuated switches are two-pole, over-center snap switches. In a still further aspect of the invention, the first and second mechanically actuated switches are mechanically actuated by the damper motor.

These and other objects and advantages of the present invention will become more readily apparent during the following detailed description taken in conjunction with the drawings herein.

BRIEF DESCRIPTION OF THE DRAWING

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

Figure 1:
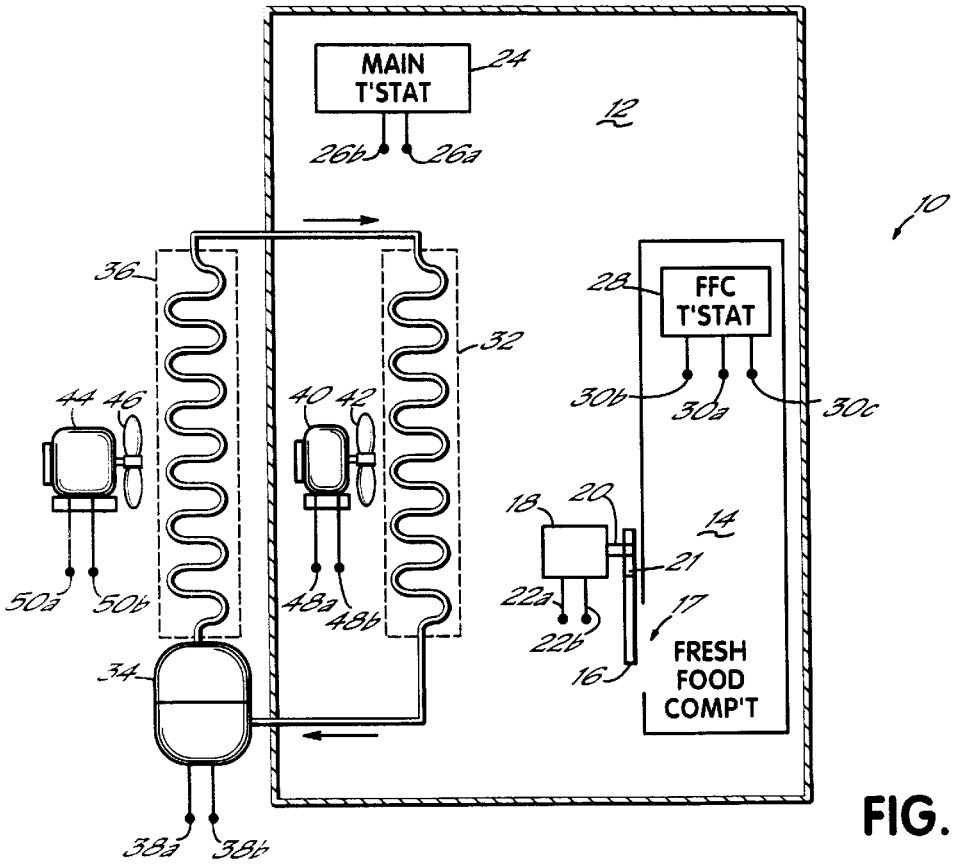
FIG. 1 is a schematic diagram of the major electrical components of a refrigeration unit having a main compartment the environment of which is controlled in response to a main thermostatic switch, and a fresh food compartment, the environment of which is controlled in response to a fresh food compartment thermostatic switch.

Referring to FIG. 1, the major electrical components of a refrigeration unit 10 such as a commercial or domestic refrigerator or freezer are schematically illustrated. Specifically, the refrigeration unit 10 includes a first, main compartment, for example, a freezer compartment, 12, and a second, fresh food compartment 14 which is separately environmentally controlled. Under thermostatic control, the freezer and fresh food compartments can be coupled together by uncovering an opening 17 therebetween with a damper door 16. Damper door 16 is opened and closed by an electric damper motor 18 powered by electrical current passing through its terminals 22*a* and 22*b*.

The damper motor 18 translates the damper door 16 between its open and closed positions by means of a cam surface 20 engaging a slot or opening 21 in the damper door 16. Such a damper door operation is fully disclosed in U.S. Pat. No. 5,477,699, entitled "Evaporator Fan Control for a Refrigerator", the entirety of which is hereby incorporated by reference herein. In this embodiment, the damper motor 18 rotates cam surface 20 through one-half a revolution, that is, 180 degrees, to open the damper door 16. The damper door 16 is closed by the damper motor 18 rotating the cam surface 20 through a second one-half revolution. Thus, during successive, full 360 degree rotations of the cam surface 20, the damper door 16 is translated back and forth through repetitive cycles during which the damper door 16 is opened and closed.

Figure 2A:
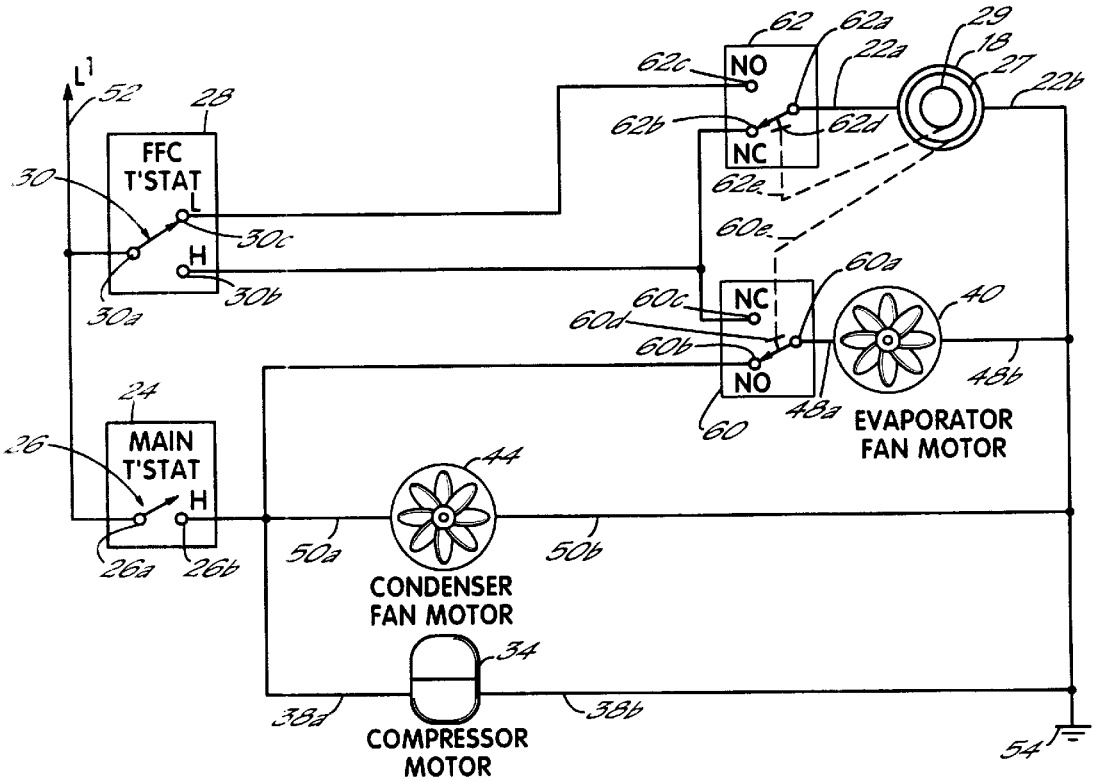
FIGS. 2A, 2B, 2C, 2D, and 2E are electrical schematic drawings of the major electrical components of the refrigeration unit of FIG. 1 connected together with mechanical switches to form an active damper control circuit, and sequentially illustrating the states of the thermostatic and mechanical switches of this control circuit during cycling of the damper door between its open and closed positions.

Inside of freezer compartment 12 is a main thermostat 24, including as a primary component a thermostatic switch 26 (FIG. 2A). In a typical application the thermostat 24 is adjustable so that the temperature of the freezer compartment 12 can be maintained at different selected temperatures. The thermostatic switch 26 inside of thermostat 24 is a single-pole switch with first and second terminals 26*a* and 26*b*. When the temperature of thermostat 24 is elevated above its set point, the internal thermostatic switch 26 closes to provide an electric current path between the switch contacts or terminals 26*a* and 26*b*. Otherwise, when the temperature of thermostat 24 is below its set point, the internal thermostatic switch 26 opens the current conducting path between terminals 26*a* and 26*b*.

Inside of the fresh food compartment 14 is a fresh food thermostat 28, which has as a primary component a second thermostatic switch 30. In a typical application the thermostat 28 is also adjustable to maintain the fresh food compartment 14 at different selected temperatures. The thermostatic switch 30 inside of thermostat 28 is a two-pole switch with three terminals 30*a*, 30*b*, 30*c*. When the temperature of thermostat 28 is elevated above its set point, the internal thermostatic switch 30 switches to a first state connecting contacts or terminals 30*a* and 30*b* and disconnecting terminals 30*a* and 30*b*, thereby providing a current conducting path between terminals 30*a* and 30*b*. Otherwise, when the temperature of thermostat 28 falls to a level below its set point, the thermostatic switch 30 switches to a second state connecting terminals 30*a* and 30*c* and disconnecting terminals 30*a* and 30*b*, thereby providing a current conducting path between terminals 30*a* and 30*c*.

Refrigeration unit 10 is cooled by a heat transfer engine, which generates heat transfer from the freezer compartment 12 by the cyclical compression, condensation, decompression and evaporation of a thermally coupled refrigerant, captured in a thermodynamic loop. The thermodynamic loop includes an evaporator 32, compressor 34, and condenser 36. As the refrigerant passes through evaporator 32, which is located inside of the freezer compartment 12, the refrigerant evaporates from a liquid to a gaseous state, absorbing heat transferred from the freezer compartment 12 into the refrigerant. The primarily gaseous refrigerant is delivered at the outlet of evaporator 32 to compressor 34, which compresses the refrigerant to a high pressure. The refrigerant passes through condenser 36, where heat transfers from the refrigerant to the environment external to freezer compartment 12, and the refrigerant then condenses from a primarily gaseous state to a primarily liquid state. The liquid refrigerant then passes back into the inlet of evaporator 32, completing the cycle.

Compressor 34 compresses primarily gaseous refrigerant received from evaporator 32, and delivers compressed refrigerant to condenser 36 by the application of mechanical force generated by an electric motor integrated within the compressor 34. This electric motor is powered by electric current received by the motor through terminals 38*a* and 38*b* of the electric motor.

To facilitate the heat transfer to and from evaporator 32 and condenser 36, fans are included in the refrigeration unit 10. Specifically, an evaporator fan motor 32 spins evaporator fan blades 42 to produce air flow over the coils of evaporator 32 to aid heat transfer to evaporator 32 from the air of freezer compartment 12. Similarly, a condenser fan motor 44 spins condenser fan blades 46 to produce air flow over the coils of condenser 36 to aid heat transfer from condenser 36 to the air external to freezer compartment 12. Evaporator fan motor 40 and condenser fan motor 44 are both electric motors that are powered by electric current passing through their respective terminals 48*a* and 48*b*, and 50*a* and 50*b*.

Referring to FIGS. 2A–2F, the electric control circuit for refrigeration unit 10 includes switches and wires connecting each of the electrical components illustrated in FIG. 1. Specifically, an electric power source supplies electrical power to the refrigeration unit 10 in the form of current passing between a "power" line or terminal 52 and a "ground" line or terminal 54. Power from this power source is switched to the various electrical elements of the refrigeration unit 10 via the thermostats 24 and 28 as well as first and second mechanically actuated switches 60, 62 which in this embodiment are two-pole over-center snap switches.

The switching elements 60*d*, 62*d* of the first and second switches 60, 62 are mechanically linked to the motion of the damper motor 18 and/or damper door 16 in a known manner. For example, in addition to the cam surface 20 which engages with and opens and closes the damper door 16 with each revolution, the damper motor 18 rotates other cam surfaces 27, 29. Control elements 60*d*, 62*d* of the respective switches 60, 62 include respective cam followers 60*e*, 62*e*, schematically illustrated by dashed lines, that ride on the respective cam surfaces 27, 29. Thus, as the damper motor 18 rotates the cam surface 20 to open and close the damper door 16, the damper motor 18 also rotates cam surfaces 27 and 29 that, in turn, mechanically switch the respective switches 60, 62 between first and second states as is appropriate for the desired operation of the damper and evaporation fan motors 18, 40. Such an arrangement is fully disclosed in the previously cited U.S. Pat. No. 4,477,699, entitled "Evaporator Fan Control for a Refrigerator".

In the circuit illustrated in FIGS. 2A–2F, the power terminal 52 of the electrical power source is connected to the first contact 26*a* of the main compartment thermostat 24. The second contact 26*b* of the main compartment thermostat 24 is connected to the first terminal 50*a* of the condenser fan 44, and to the first terminal 38*a* of the compressor motor 34. The second terminals 50*b* and 38*b* of the condenser fan motor 44 and compressor motor 34, are both respectively connected to the ground terminal 54 of the electrical power source.

The second contact or terminal 26*b* of the main compartment thermostat 24 is connected to the normally-open contact or terminal 60*b* of the first mechanically actuated switch 60. The common contact 60*a* of the first switch 60 is connected to the first terminal 48*a* of the evaporator fan motor 40, and the second terminal 48*b* of the evaporator fan motor 40 is connected to the ground terminal 54. The normally-closed contact 60*c* of the first switch 60 is connected in common with the high temperature limit contact 30*b* of the fresh food compartment thermostat 28 and the normally-closed contact 62*b* of the second mechanically actuated switch 62.

The common contact or terminal 62*a* of the second switch 62 is connected to the first terminal 22*a* of the damper motor 18, and the second terminal 22*b* of the damper motor 18 is connected to the ground terminal 54. The normally-open contact 62*c* of the second switch 62 is connected to the low temperature limit contact 30*c* of the fresh food compartment thermostat 28. The common contact 30*a* of the fresh food compartment thermostat 28 is connected to the power terminal 52 of the power source.

In use, as a result of the above connections, the desired operation of the various motors and fans is achieved. Specifically, FIG. 2A illustrates the "open" condition of the thermostatic switch 26 in response to the main thermostat 24 sensing a temperature below its high temperature limit. FIG. 2A also illustrates the condition of the thermostatic switch 30 in response to the fresh food compartment thermostat 28 sensing a temperature below the high temperature limit. With that temperature condition, the thermostatic switch 30 is in its default state in which the common contact 30*a* connected to the low temperature contact 30*c*. As long as the fresh food compartment 14 has a temperature below the high temperature limit of the fresh food compartment thermostat 28, the thermostat 28 and first and second switches 24, 28 remain in the states illustrated in FIG. 2A.

Figure 2B:
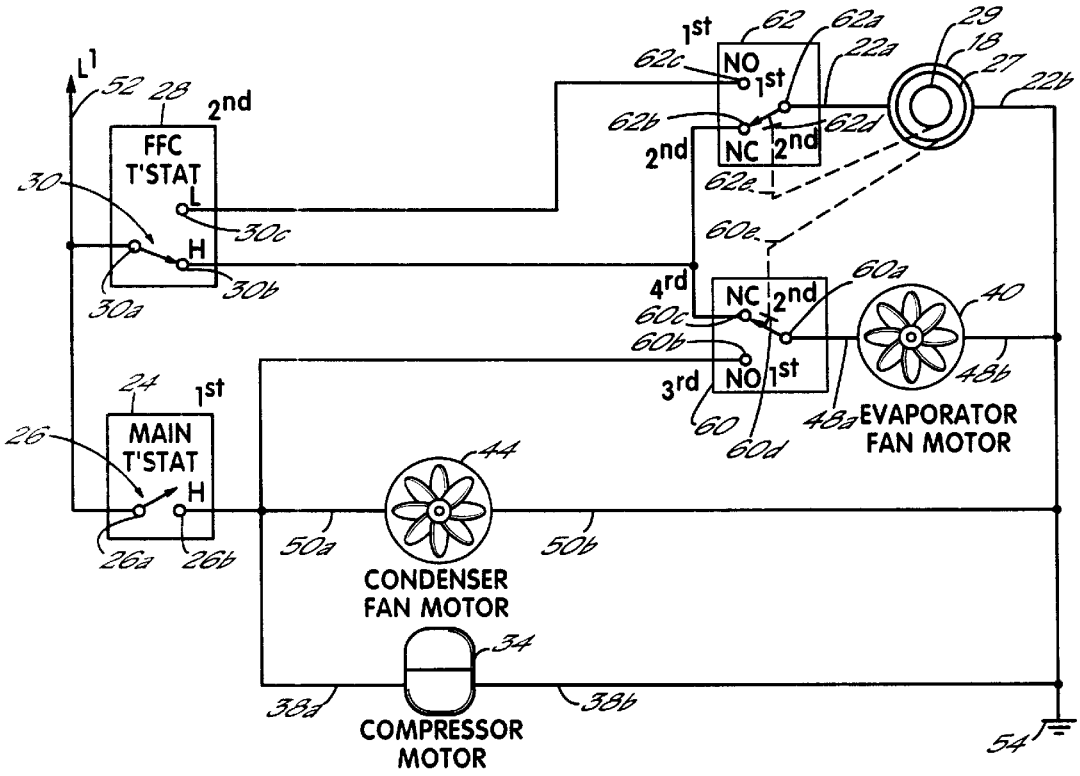

As the fresh food compartment 14 loses heat, the fresh food compartment thermostat 28 senses higher temperatures until it senses a temperature equal to or above its high temperature limit. At that point, the fresh food thermostat 28 switches the thermostatic switch 30 to the state illustrated in FIG. 2B, thereby disconnecting contacts 30*a* and 30*c* and connecting the contacts 30*a* and 30*b*. Power is applied to contact 30*b*, to the normally-closed and common contacts 62*b* and 62*a*, respectively, of the second switch 62 and then to the damper motor 18. Thus, the second contact 30*b* of switch 30 connects the power source 52 to the damper motor 18; and the damper motor 18 begins rotating the cam surfaces 20, 27, 29, thereby opening the damper door 16. After the damper motor 18 has rotated through almost 180°, the cam surface 27 being rotated by the damper motor 18 moves the control element 60*d* of the first mechanically actuated switch 60 to its second position as illustrated in FIG. 2B, thereby connecting the common contact 60*a* with the normally-closed contact 60*c* that, in turn, is connected to the high limit contact 30*b*. Thus, the contact 60*c* connects the power source to the evaporator fan motor 40, thereby turning the evaporator fan motor ON.

Figure 2C:
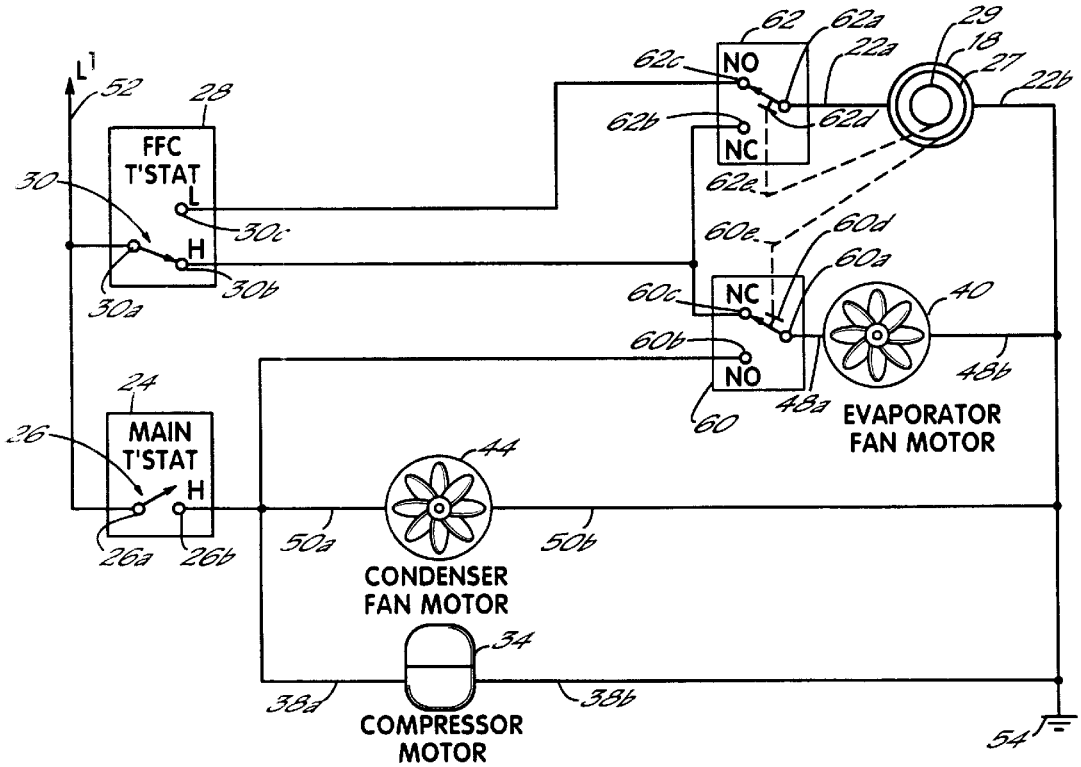
Figure 2D:
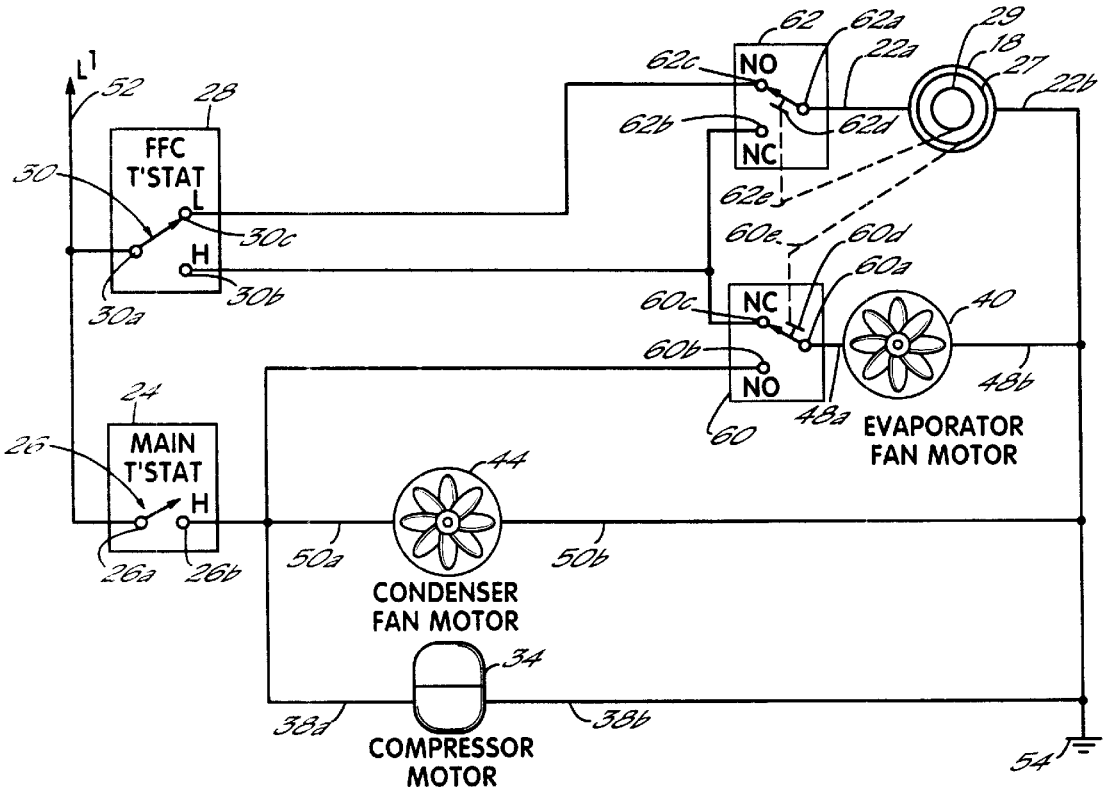

As the damper motor 18 moves to a position representing 180° of rotation, the damper door 16 is fully opened, and the second mechanically actuated switch 62 is switched to its second state as illustrated in FIG. 2C. The normally closed contact 62*b* is disconnected from the common contact 62*a* and power is removed from the damper motor 18, thereby causing the damper motor 18 to stop. In its second state, the normally-open contact 62*c* within the second switch 62 is connected to the common contact 62*a*.

With the damper door 16 open and the evaporator fan motor 40 running, colder air from the main or freezer compartment 12 is circulated into the fresh food compartment 14. The temperature in the fresh food compartment is lowered until it falls to a temperature value below the high temperature limit of the fresh food compartment thermostat 28. At that point, the fresh food compartment thermostat 28 switches the thermostatic switch 30 to the low temperature state illustrated in FIG. 2D. In that state, the common contact 30*a* is disconnected from the high temperature limit contact 30*b*, thereby removing power from the normally-open contact 60*c* of the second switch 60, the common contact 60*a* and the evaporator fan motor 40, thereby turning the evaporator fan motor 40 OFF.

Figure 2E:
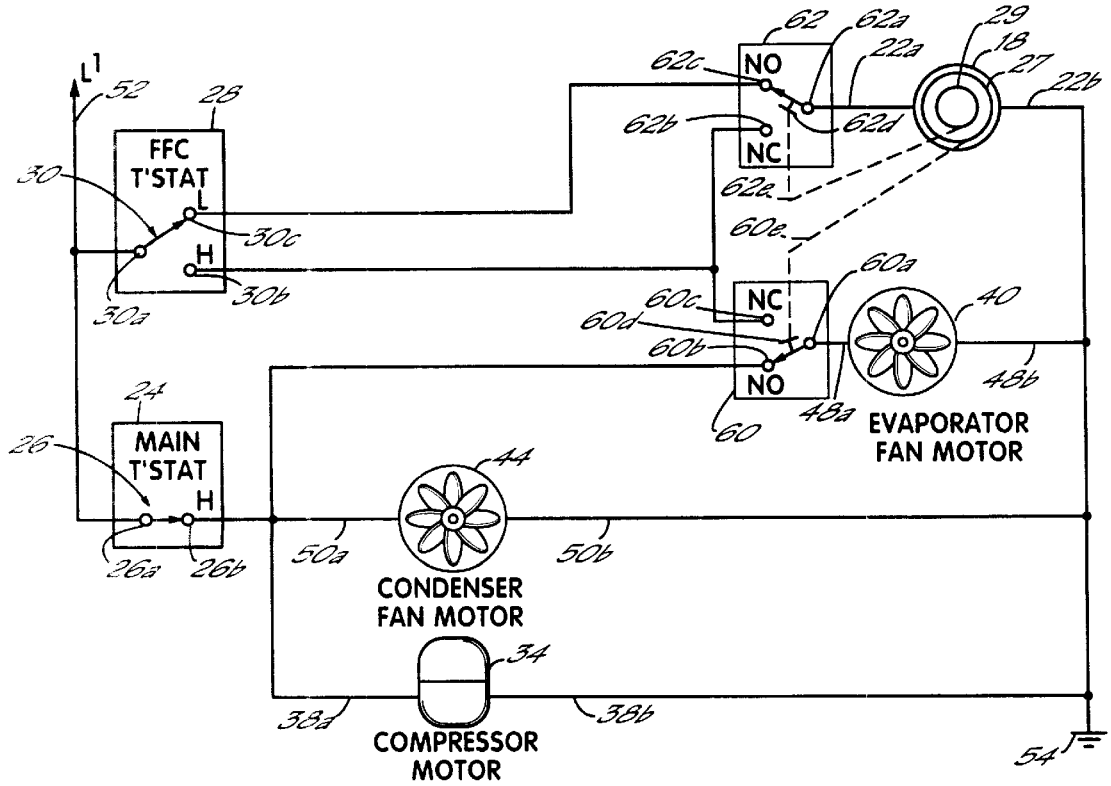

In the low temperature state, the common contact 30*a* is connected to the low temperature limit contact 30*c*; and power from terminal 52 is applied to the normally-open contact 62*c*, to the common contact 62*a* and then to the damper motor 18. The damper motor 18 is again turned ON and begins to rotate the cam surfaces 20, 27, 29 which is effective to being closing the damper door 16. After the damper motor 18 has rotated the cam surface 27 through approximately 20 degrees of angular rotation, the first mechanically actuated switch 60 is switched back to its first state as illustrated in FIG. 2E. That action disconnects the normally-closed contact 60*c* from the common contact 60*a* and connects the normally-open contact 60*b* with the common contact 60*a*.

The damper motor 18 continues to rotate the cam surfaces 20, 27, 29 through 180 degrees of rotation back to their starting angular position. As cam surface 29 reaches its starting angular position, the second mechanically actuated switch 62 is switched to its first state as shown in FIG. 2A, thereby disconnecting the normally-open contact 62*c* from the common contact 62*a*. That switching action disconnects power from the damper motor 18 and turns the damper motor 18 OFF; and the circuit elements are in their starting states ready for the next call for cooling from the fresh food thermostat 28.

If, from the state illustrated in FIG. 2A, the freezer compartment temperature elevates to an extent that the thermostatic switch 26 in the main compartment thermostat 24 closes as illustrated in FIG. 2E, then a current path exists from the terminal 52, through the thermostatic switch 26 via the common contact 26*a* and the high limit contact 26*b* and to each of the condenser fan motor 44 and compressor motor 34. Current flowing through contact 26*b* of main compartment thermostat 24 will also flow through contact 60*b* to the evaporator fan motor 40, provided that the damper door is closed at the time and mechanically actuated switch 60 is in the positions shown in FIG. 2A. If the damper door 16 is open, as described above, current will flow through evaporator fan motor 40 via contact 60*c* of mechanically actuated switch 62. Thus, if the main compartment thermostat 24 closes the thermostatic switch 26, the compressor motor 34 and each of the evaporator and condenser fan motors 40 and 44 will operate, thereby cooling the freezer compartment in the manner described above. This cooling activity will continue until the freezer compartment temperature falls below the high temperature threshold set by the main compartment thermostat 24, at which time the thermostatic switch 26 opens, thereby returning the circuit to the condition shown in FIG. 2A. Opening the thermostatic switch 26 removes electrical power form contact 26*b*, and current will cease to flow through the compressor and condenser fan motors 34 and 44, and will also cease to flow through the evaporator fan motor 40 if the damper door is closed.

Thus, the novel refrigeration damper door circuit described herein uses a main compartment thermostat, a fresh food compartment thermostat and two mechanically actuated switches to control the damper and evaporation motors of a refrigeration unit, and thus avoids the cost and potential reliability drawbacks of using more than two mechanically actuated switches and other components.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. For example, in the described embodiment, the invention is used to control the flow of cooling air from a freezer compartment to a fresh food compartment. It should be noted that a fresh food compartment may be any storage section in the refrigeration unit. For example, it may be a large general refrigeration section, or a separate meat keeping section, or a separate vegetable keeping section or a drawer. Thus, the invention is generally applicable to any requirement for moving cooling air between different storage sections of a refrigeration unit. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A control circuit for supplying current from an electrical power source to a damper motor and evaporator fan motor of a two compartment refrigeration unit to control operation of the damper motor and evaporator fan motor, the damper motor opening and closing a damper door between first and second refrigeration compartments, the control circuit comprising a first thermostatic switch adapted to regulate temperature in the first refrigeration compartment, the first thermostatic switch being connected to the electrical power source and providing an electrical path therethrough in response to an increase in temperature in the first compartment;

a second thermostatic switch adapted to regulate temperature in the second refrigeration compartment, the second thermostatic switch being connected to the electrical power source and providing first and second electrical paths therethrough in response a respective increase and decrease in temperature in the second compartment;

a first mechanically actuated switch having a first common contact electrically connected to the damper motor, a first contact electrically connected to the second thermostatic switch and connecting the damper motor to the power source in response to a decrease in temperature in the second compartment, and a second contact electrically connected to the second thermostatic switch and connecting the damper motor to the power source in response to an increase in temperature in the second compartment; and a second mechanically actuated switch having a second common contact electrically connected to the evaporator fan motor, a third contact electrically connected to the first thermostatic switch and electrically connecting the evaporator fan motor to the power source in response to an increase in temperature of the first compartment, and a fourth contact electrically connected to the second thermostatic switch and electrically connecting the power source to the evaporator fan motor in response to an increase in temperature of the second compartment.

2. A control circuit of claim 1 wherein the first and second mechanically actuated switches are in mechanical communication with and actuated by the damper motor.

3. A control circuit of claim 2 wherein the first contact electrically connects the damper motor to the power source in response to a decrease in temperature in the second compartment and a first state of the first mechanically actuated switch.

4. A control circuit of claim 3 wherein the second contact electrically connects the damper motor to the power source in response to an increase in temperature in the second compartment and a second state of the first mechanically actuated switch.

5. A control circuit of claim 4 wherein the third contact electrically connects the evaporator fan motor to the power source in response to an increase in temperature in the first compartment and a first state of the second mechanically actuated switch.

6. A control circuit of claim 5 wherein the fourth contact electrically connects the evaporator fan motor to the power source in response to an increase in temperature in the second compartment and a second state of the second mechanically actuated switch.

7. A control circuit of claim 6 wherein the damper motor switches the second switch from the first state to the second state in response to the damper motor moving through a first angular displacement in a direction opening the damper door.

8. A control circuit of claim 7 wherein the damper motor switches the first switch from the second state to the first state in response to the damper motor moving through a second angular displacement in a direction closing the damper door.

9. A control circuit of claim 8 wherein the first angular displacement is less than the second angular displacement.

10. A control circuit of claim 8 wherein the first and second angular displacements are approximately equal.

11. A control circuit of claim 8 wherein the damper motor switches the second switch from the second state to the first state in response to the damper motor moving through a third angular displacement in a direction opening the damper door.

12. A control circuit of claim 11 wherein the damper motor switches the first switch from the first state to the second state in response to the damper motor moving through a fourth angular displacement in a direction opening the damper door.

13. A control circuit of claim 12 wherein the third angular displacement is less than the fourth angular displacement.

14. A control circuit of claim 12 wherein the third and fourth angular displacements are approximately equal.

15. A control circuit of claim 12 wherein the second and fourth angular displacements are equal to approximately 180 degrees of angular rotation of the damper motor.

16. A control circuit of claim 1 wherein the first thermostatic switch is a single-pole thermostatic switch.

17. A control circuit of claim 1 wherein the second thermostatic switch is a two-pole thermostatic switch.

18. A control circuit of claim 1 wherein the first and second mechanically actuated switches are mechanically actuated two-pole switches.

19. A control circuit of claim 1 wherein the first and second mechanically actuated switches are mechanically actuated two-pole, over-center, snap switches.

20. A control circuit of claim 1 wherein the first and second contacts are a normally-open contact and a normally-closed contact, respectively, of the first mechanically actuated switch.

21. A control circuit of claim 20 wherein the third and fourth contacts are a normally-open contact and a normally-closed contact, respectively, of the second mechanically actuated switch.

22. A control circuit for supplying current from an electrical power source to a damper motor and evaporator fan motor of a two compartment refrigeration unit to control operation of the damper motor and evaporator fan motor, the control circuit comprising a first thermostatic switch adapted to regulate temperature in a first refrigeration compartment and having one contact electrically connected to a source of power, and a further contact electrically connected to the first contact in response to an increase in temperature in the first compartment;

a second thermostatic switch adapted to regulate temperature in a second refrigeration compartment and having one contact electrically connected to the source of power, a first other contact electrically connected to the one common contact in response an increase in temperature in the second compartment, and a second other contact electrically connected to the one other contact in response to a decrease in temperature in the second compartment;

a first mechanically actuated switch having a first common contact electrically connected to the damper motor, a first contact electrically connecting the first common contact with the second other contact in response to a first switch state, and a second contact electrically connecting the first common contact with the first other contact in response to a second switch state; and a second mechanically actuated switch having a second common contact electrically connected to the evaporator fan motor, a third contact electrically connecting the second common contact with the further contact in response to a first switch state, and a fourth contact electrically connecting the second common contact with the second other contact and the second contact in response to a second switch state, whereby the damper motor is connected to the power source in response to the second thermostat sensing both an increase in the temperature and a decrease in the temperature in the second compartment, and the evaporator fan motor being connected to the power source in response to both the first and second thermostats sensing an increase in temperature.

23. A control circuit for supplying current from an electrical power source to a damper motor and evaporator fan motor of a two compartment refrigeration unit to control operation of the damper motor and evaporator fan motor, the control circuit comprising a single-pole thermostatic switch adapted to regulate temperature in a first refrigeration compartment and having one contact electrically connected to a source of power, a further contact, and a current path between the contacts of the single-pole thermostatic switch in response to an increase in temperature in the first compartment;

a two-pole thermostatic switch adapted to regulate temperature in a second refrigeration compartment and having one contact electrically connected to the source of power, two other contacts, a first current path between the one contact and a first other contact in response an increase in temperature in the second compartment, and a second current path between the one contact and a second other contact providing in response to a decrease in temperature in the second compartment;

a first, two-pole, mechanically actuated switch having a first common contact electrically connected to the damper motor, a first contact being electrically connected to the first common contact in response to a first switch state, the first contact being connected to the second other contact, and a second contact being electrically connected to the first common contact in response to a second switch state, the second contact being connected to the first other contact; and a second, two-pole, mechanically actuated switch having a second common contact electrically connected to the evaporator fan motor, a third contact being electrically connected to the second common contact in response to a first switch state, the third contact being electrically connected to the further contact of the single-pole thermostatic switch, and a fourth contact being electrically connected to the second common contact in response to a second switch state, the fourth contact being electrically connected to the second other contact and the second contact, whereby the damper motor is connected to the power source in response to the second thermostat sensing both an increase in the temperature and a decrease in the temperature in the second compartment, and the evaporator fan motor being connected to the power source in response to both the first and second thermostats sensing an increase in temperature.

24. In a refrigerator having first and second compartments, a compressor for compressing refrigerant, a condenser mounted external the compartments and receiving compressed refrigerant from the compressor, condensing the refrigerant and transferring heat from the refrigerant to a region outside of the compartments, an evaporator mounted in the first compartment and receiving condensed refrigerant from the condenser, evaporating the refrigerant and transferring heat from the inside of the first compartment to the refrigerant, an evaporator fan motor for driving a fan and generating air flow over the evaporator, a damper door which when opened permits air flow between the two compartments, a damper motor for moving the damper door, and a control circuit for supplying current from an electrical power source to the damper motor and evaporator fan motor to control operation of the damper motor and evaporator fan motor, the control circuit comprising a first thermostatic switch for regulating the temperature in the first compartment and being connected to the electrical power source;

a second thermostatic switch for regulating the temperature in the second compartment and being connected to the electrical power source;

a first mechanically actuated switch having a first common contact electrically connected to the damper motor, first and second contacts, each of the first and second contacts being selectively connected to the first common contact in response to one of two different states of the first mechanically actuated switch state, the first contact being electrically connected to the electrical power source and operating the damper motor in response to the second thermostatic switch sensing a decrease in temperature in the second compartment, and the second contact being electrically connected to the electrical power source and operating the damper motor in response to the second thermostatic switch sensing an increase in temperature in the second compartment; and a second mechanically actuated switch having a second common contact electrically connected to the evaporator fan motor, third and fourth contacts, each of the third and fourth contacts being selectively connected to the second common contact in response to one of two different states of the second mechanically actuated switch, the third contact being electrically connected to the electrical power source and operating the evaporator fan motor in response to the first thermostatic switch sensing an increase in the temperature in the first compartment, and the fourth contact being electrically connected to the electrical power source and operating the evaporator motor in response to one of the first and second thermostatic switches sensing an increase in temperature in their respective first and second compartments.

25. A refrigeration unit, comprising a main compartment;

a compressor for compressing refrigerant;

a condenser mounted external to the main compartment receiving compressed refrigerant from the compressor, and condensing the refrigerant and transferring heat from the refrigerant to a region outside of the main compartment;

an evaporator mounted internal to the main compartment receiving condensed refrigerant from the condenser, and evaporating the refrigerant and transferring heat from the inside of the main compartment to the refrigerant;

an evaporator fan motor internal to the main compartment for driving a fan and generating air flow over the evaporator;

a second compartment thermally isolatable from the main compartment, the second compartment having an active damper door which when opened permits air flow between the second compartment and the main compartment;

a damper motor for moving the damper door;

a first thermostatic switch for regulating the temperature in the main compartment and being connected to the electrical power source;

a second thermostatic switch for regulating the temperature in the second compartment and being connected to the electrical power source;

a first mechanically actuated switch having a first common contact electrically connected to the damper motor, first and second contacts, each of the first and second contacts being selectively connected to the first common contact in response to one of two different states of the first mechanically actuated switch state, the first contact being electrically connected to the electrical power source and operating the damper motor in response to the second thermostatic switch sensing a decrease in temperature in the second compartment, and the second contact being electrically connected to the electrical power source and operating the damper motor in response to the second thermostatic switch sensing an increase in temperature in the second compartment; and a second mechanically actuated switch having a second common contact electrically connected to the evaporator fan motor, third and fourth contacts, each of the third and fourth contacts being selectively connected to the second common contact in response to one of two different states of the second mechanically actuated switch, the third contact being electrically connected to the electrical power source and operating the evaporator fan motor in response to the first thermostatic switch sensing an increase in the temperature in the main compartment, and the fourth contact being electrically connected to the electrical power source and operating the evaporator motor in response to one of the first and second thermostatic switches sensing an increase in temperature in their respective main and second compartments.

* * * * *

UNITED STATES PATENT AND TRADEMARK OFFICE

CERTIFICATE OF CORRECTION

PATENT NO. : 6,067,809
DATED : May 30, 2000
INVENTOR(S) : David R. Whited

It is certified that error appears in the above-identified patent and that said Letters Patent is hereby corrected as shown below:

Title page,
Item [57], ABSTRACT,
Line 3, delete "includes a first" and insert -- includes first --.

Column 2,
Line 29, delete "response a", insert -- response to a --.

Column 5,
Lines 54-55, delete "contact 30a connected", insert -- contact 30a is connected --.

Column 6,
Line 45, delete "being", insert -- begin --.

Column 7,
Line 22, delete "power form contact", insert -- power from contact --.
Line 36, delete "applicants", insert -- applicant --.

Column 8,
Line 5, delete "response a", insert -- response to a --.

Column 9,
Line 53, delete "response an", insert -- response to an --.

Column 10,
Line 37, delete "response an", insert -- response to an --.
Line 40, delete "providing".

Signed and Sealed this

Twenty-seventh Day of December, 2005

JON W. DUDAS
*Director of the United States Patent and Trademark Office*